United States Patent [19]

Budrys et al.

[11] 3,978,392

[45] Aug. 31, 1976

[54] ENERGY TRANSFER CIRCUIT

[75] Inventors: Ignas Budrys, Bethel; Robert W. Right, Huntington, both of Conn.

[73] Assignee: General Signal Corporation, Rochester, N.Y.

[22] Filed: May 8, 1975

[21] Appl. No.: 575,568

[52] U.S. Cl. ..... 323/16; 307/127; 307/157; 317/8; 323/39; 340/253 R

[51] Int. Cl.[2] ..... G08B 13/22

[58] Field of Search ..... 307/108, 127, 132 R, 307/132 V, 138, 146, 157; 317/8, 9 D, 151; 323/16, 19, 22 T, 39; 340/253 R

[56] References Cited

UNITED STATES PATENTS

| | | | |
|---|---|---|---|
| 3,377,541 | 4/1968 | Farkas | 307/108 X |
| 3,832,599 | 8/1974 | Grundy | 317/151 X |

*Primary Examiner*—A. D. Pellinen
*Attorney, Agent, or Firm*—Milton E. Kleinman; George W. Killian

[57] ABSTRACT

An electrical load is energized from an energy source that may not have the capacity to carry the load directly. More specifically, a capacitor is charged at a low charge current for a relatively long period of time and when the load is to be energized, the capacitor is discharged through the load in a relatively short period of time. Current limiting devices protect the power source. The charge and discharge intervals are initiated in response to polarity reversals of the power source. When the power source presents one polarity, the capacitor is charged; and in response to a polarity reversal, the capacitor is discharged through the load. A plurality of capacitors and associated load circuits may be connected to a single power source without feedback between the circuits. A current limiting device may be used to limit the initial load current. Typically, the load may comprise a plurality of lamps, horns, bells or buzzers to indicate an alarm condition. Since the power supply is not required to directly energize the alarm devices, the power supply may be smaller and more economical.

18 Claims, 3 Drawing Figures

ENERGY TRANSFER CIRCUIT

BACKGROUND OF THE INVENTION

It is widely recognized that electricity must be generated to match the instantaneous load and cannot be manufactured and stored during slack periods to satisfy peak demands. Accordingly, a power source must have the capacity to provide the instantaneous peak load required. In situations were the peak load exists for a relatively small percentage of the time, it means that the power source must have the capacity to supply the peak load required, but during off peak time, the power supply operates at less than its capacity. Examples include: the automobile battery which must be able to provide the cranking energy to start an automobile, but which at other times provides relatively little energy; the power supply which must provide the high currents for arc welding; and the relatively large currents required by many machines during small portions of their cycles of operations. Various techniques have been employed to minimize load peaks. One of the more obvious techniques is to schedule the connection of loads so that major consumers of electricity are not simultaneously demanding their respective maximum requirements.

Devices which are intermittently actuated may require substantial instantaneous power while the average power used over a extended period of time is relatively small. A typical example includes alarm lamps, bells or horns which are intermittently actuated for a second or so every few seconds.

The present invention teaches a means for extracting energy from a power source at a relatively low rate for a relatively extended period of time and storing the same in a capacitor. Subsequently, the stored energy is discharged in the load in a relatively brief time interval. This concept is not broadly new and has been used, for many years, in circuits for firing photoflash lamps. Other applications of the general principle will readily occur to those familiar with the applicable arts.

SUMMARY OF THE INVENTION

The invention teaches a means for extracting energy from a power source at a relatively low rate for a relatively extended period of time and storing the extracted energy in a capacitor from which it is drawn at a high rate in a relatively short period of time. The time duration of the charging circuit and the time duration of the discharging circuit are determined by the time intervals between polarity changes of the power supply. That is, polarity sensing means are provided for allowing a capacitor to be charged when the power supply has one polarity and for allowing the capacitor to discharge through a load when the power supply has another polarity. A plurality of capacitors and associated loads may be coupled to a common power supply without feedback between circuits. Circuit means may be used in the power supply to limit the maximum current provided by the power supply. In addition, circuit means may be associated with the load to limit the load current. The capacitor charge circuit may include a diode to make the circuit sensitive to source polarity. The load circuit may include a darlington amplifier.

It is an object of the invention to provide means for the intermittent energizing of a load with power from a source which may not have the capacity for direct energization of the load.

It is another object of the invention to charge a capacitor and subsequently discharge it through a load in response to sensing a polarity reversal of the power supply.

It is another object of the invention to provide a plurality of charge and discharge circuits connected in parallel without feedback therebetween.

It is another object of the invention to provide means for reversing the polarity of a power supply and for storing energy in a capacitor while the power supply has one polarity and for discharging the capacitor through a load while the power supply has the other polarity.

It is another object of the invention to provide means for limiting the rate of discharge of a charged capacitor through a load.

BRIEF DESCRIPTION OF THE DRAWING

The above and other objects and advantages of the invention will become more apparent as the following description is considered together with the drawing in which.

DESCRIPTION OF THE PREFERRED EMBODIMENT

Figure 1:
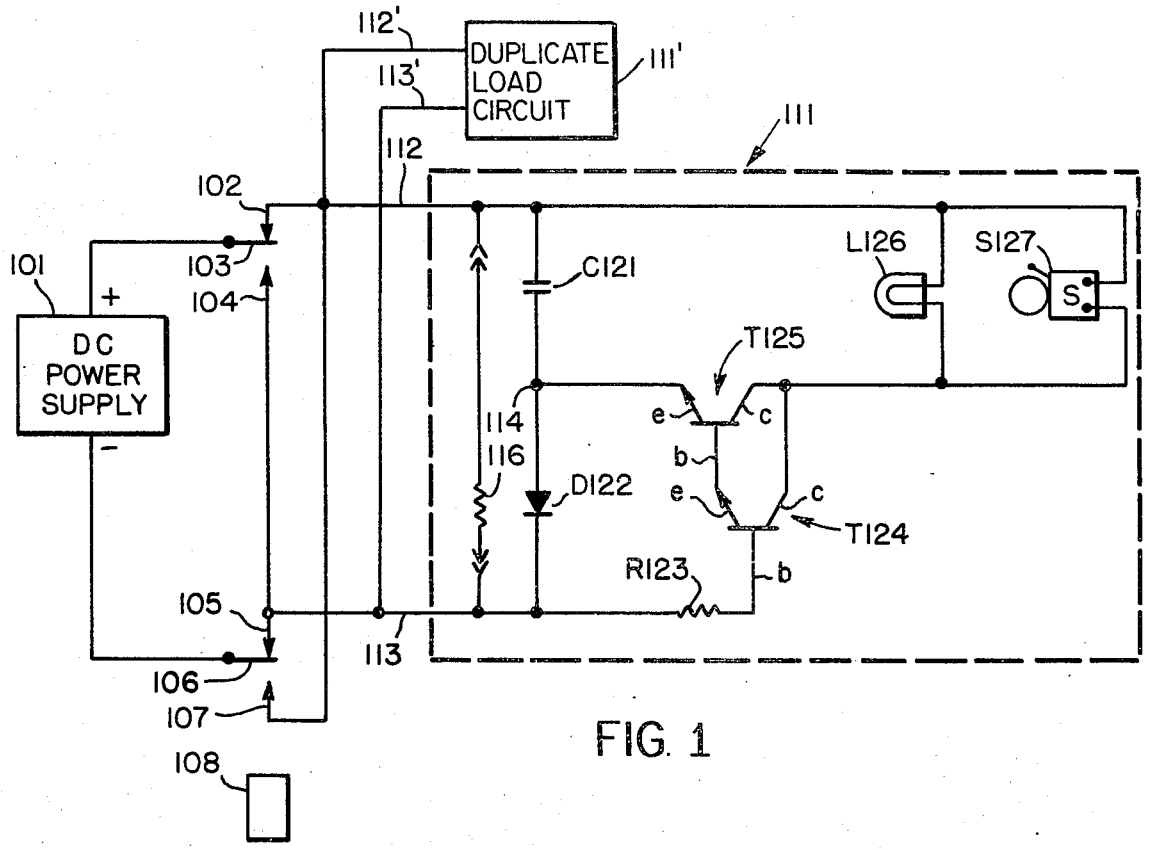
FIG. 1 comprises a circuit incorporating the invention.

Considering now more specifically the preferred embodiment of the invention as illustrated in FIG. 1, there will be seen a d.c. power supply 101 having positive and negative terminals as illustrated by the + and − symbols. The + and − terminals of the d.c. power supply 101 are connnected, respectively, to swingers 103 and 106 of the contact sets 102–107 associated with the contact actuator 108. The contact actuator 108 may comprise a relay or some type of mechanical means for systematically and periodically actuating the contact sets 102–107. During a first time interval, the contacts 102 and 103 will be electrically continuous, and simultaneously therewith the contacts 105 and 106 will be electrically continuous. At some other time and in response to an actuation of the contact actuator 108, the contacts 103 and 106 will physically move so that contacts 103 and 104 are electrically continuous, and simultaneously therewith contacts 106 and 107 will be electrically continuous. Both electrical and mechanical means for actuating contact sets are old and well known and do not form a part of the present invention and therefore it is believed that disclosure of further details concerning actuation of these contacts would only tend to unnecessarily complicate the drawing and divert attention from the novel aspects thereof. It should be understood that contact 103 breaks from contact 102 prior to the time that it makes with contact 104 and that in a similar fashion contact 106 breaks from contact 105 prior to the time that it makes with contact 107 and, furthermore, that both breaking actuations occur prior to either making actuation. The described sequence of events, and a similar sequence as the contacts operate to restore to their illustrated position, eliminates the possibility of inadvertently shorting the d.c. power supply 101.

Coupled to the d.c. power supply 101 through the contact sets 102–107 is a load circuit illustrated generally as 111. A similar load designated 111' may also be connected in parallel. Additional similar loads (not shown) may be coupled in a similar manner. It will be seen that when the contact sets 102–107 are in the illustrated position, that leads 112 and 113 are coupled, respectively, to the positive and negative terminals of the d.c. power supply 101. However, in response to the actuation of the contact actuator 108 and the operation of the contact sets 102–107, it will be seen that the lead 112 is coupled through now closed contacts 107 and 106 to the − terminal of the d.c. power supply 101, while the lead 113 is coupled through contacts 104 and 103 to the + terminal of the d.c. power supply 101. Accordingly, it will be seen that the periodic actuation of the contact sets 102–107 will cause the polarity of the potential applied to the load 111 and/or the load 111′ to be periodically reversed.

The load 111 will be seen to comprise a capacitor C121, a diode D122, a resistor R123, first and second transistors T124 and T125, a lamp L126 and a sounder S127. Each of the transistors T124 and T125 have three elements; a base designated *b*, a collector designated *c* and an emitter designated *e*.

It will be seen that with the polarity of the d.c. power supply 101 as shown, and with the contact sets 102–107 as shown, the lead 112 will be positive and conventional current can flow from the positive lead 112 through capacitor C121 and diode D122 to the negative lead 113. For the time interval that these conditions prevail, the capacitor C121 will be charged with a positive potential at its upper plate and a negative potential at its lower plate. The d.c. power supply 101 may include means for limiting the output current to a predetermined maximum. Accordingly, the capacitor C121 in the load 111 and/or the corresponding capacitor in the load 111′ will be charged at a rate, and to a potential, determined by the characteristics of the d.c. power supply 101. The negative potential applied to lead 113 will be conducted through resistor R123 to the base *b* of transistor T124. The positive potential on lead 112 will be applied through lamp L126 to the collectors of the transistors T124 and T125. The emitter *e* of transistor T125 will be seen to be coupled to the lead 113 through diode D122 and, therefore, the emitter *e* of transistor T125 is at a negative potential only slightly more positive than that of lead 113. The transistors T124 and T125 are of the NPN type and will not conduct unless the base is positive with respect to the emitter and/or collector. Since these conditions do not prevail, the transistors T124 and T125 do not conduct and no current flows to illuminate the lamp L126 or actuate the sounder S127 in parallel with the lamp L126.

Under normal operating conditions, the frequency of actuation of the contact sets 102–107 is sufficiently slow to allow capacitor C121 to become fully charged. In a typical application of the invention, the alarms will be sounded for approximately one second and remain silent for at least an equal period of time or perhaps a few times longer. After the capacitor is fully charged, the contact actuator 108 will actuate the contact sets 102–107 and reverse the polarity on the leads 112 and 113 so that they are − and +, respectively. As soon as this polarity reversal takes place, the capacitor C121 ceases to charge and current to it from the d.c. power supply 101 is blocked by the diode D122 which inhibits the flow of currrent from lead 113 through the diode D122 and the capacitor C121 to the lead 112. With the positive potential from power supply 101 applied through contacts 102 and 104 to lead 113, it will be seen that the base *b* of transistor T124 is at a positive potential. Simultaneously therewith, the negative potential from the d.c. power supply 101 will be applied through closed contacts 106 and 107 to lead 112 and through lamp L126 to the collectors *c* of the transistors T124 and T125. The negative potential at the lower plate of capacitor C121 is applied to the emitter *e* of transistor T125. These conditions turn on the transistors T124 and T125 and they start to conduct. Although the lead 112 is coupled to the negative terminal of the d.c. power supply 101, it is also coupled to the upper plate of the capacitor 121 and the upper plate of the capacitor 121 is positive with respect to the lower plate of the capacitor C121. Thus, the lower plate of the capacitor C121 is at a more negative potential than the negative potential of the d.c. power supply 101. Or considered from a slightly different view, the base *b* of the transistor T124 is more positive than the emitter *e*. With the transistors T124 and T125 turned on, the energy stored in capacitor C121 can flow from its upper plate through the parallel combination of the lamp L126 and the sounder S127 and through the collector to emitter circuit of transistor T125 to the lower plate of the capacitor C121. The cathode of the diode D122 is coupled directly to the positive terminal of the d.c. power supply 101 and the anode of diode D122 is at a negative potential and, therefore, no current passes through diode D122. In response to the passage of the current through lamp L126 and sounder S127, the lamp and sounder will be actuated to provide visual and audible alarms.

By the means described, energy may be taken from a power supply at a relatively slow rate and stored in a capacitor, and subsequently the energy may be withdrawn from the capacitor and dissipated through a load in a relatively short time interval.

The transistors T124 and T125 are coupled in a darlington transistor-amplifier circuit and tends to limit the initial current. This is desirable because of the relatively low cold resistance of the lamp L126.

While the leads 112 and 113 are in parallel with the leads 112′ and 113′, the point 114 and corresponding point (not shown) in load 111′ are not coupled together and, therefore, the capacitor C121 and the corresponding capacitor (not shown) in load 111′ will provide energy only to their respective lamps L126 and sounder S127. That is, there is no feedback of energy from the capacitor C121 of circuit 111 to a load 111′.

By the periodic actuation of the contact actuator 108, the polarity of the leads 112 and 113 may be selectively switched from one polarity to another and since the diode D122 is polarity sensitive, the capacitor C121 will be charged only while the leads 112 and 113 have a first predetermined polarity relationship. The darlington amplifier comprising transistors T124 and T125 constitutes a second polarity responsive means that responds to a second predetermined polarity relationship for allowing the energy stored in capacitor C121 to be discharged in the lamp and sounder load.

During standby conditions, the d.c. power supply 101 may be turned off, or the contact actuator 108 may be left in the condition illustrated with the capacitor C121 charged.

In a practical application of the circuit, the following components were used;

| Element | Item No. | Value |
|---|---|---|
| Capacitor | C121 | 5,000 microfarads 50 volts |
| Resistor | R123 | 240,000 ohms |
| Transistor | T124 | 2N5366 |
| Transistor | T125 | 2N6121 |

Other components may be used depending upon the requirements of the particular application and the desired sound duration period and repetition rate.

Figure 2:
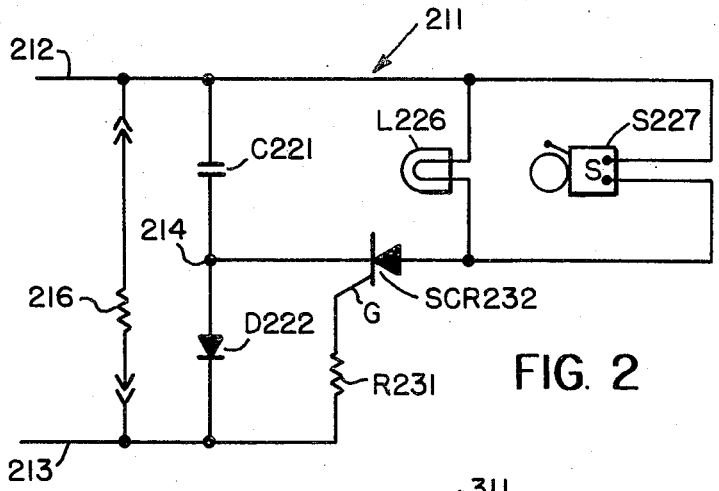
FIGS. 2 and 3 illustrate alternate forms of a portion of the circuit of FIG. 1.
Figure 3:
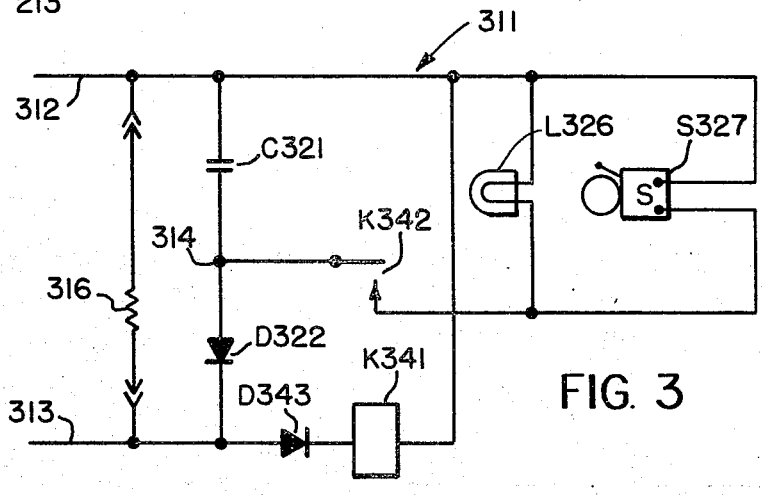

Considering now more specifically the circuits of FIGS. 2 and 3, there will be seen therein circuits which may be substituted for load 111 or 111' shown in FIG. 1. In each case, elements which correspond directly with similar elements in FIG. 1 have been given corresponding numbers except for the first digit, which corresponds with the figure number. For example, the leads 212 and 213 could be coupled to the d.c. power supply 101 by being connected to contacts 102 and 105, respectively, of the contact actuator 108. In a similar manner, leads 312 and 313 could be connected to the d.c. power supply 101. In both cases, the capacitor C221, or C321, will be charged in a manner similar to that described with respect to capacitor C121 in FIG. 1.

While the capacitor C221 of FIG. 2 is being charged, the positive potential on lead 212 is applied through the lamp L226 and/or the sounder S227 to the anode of the silicon controlled rectifier SCR 232. The cathode of the SCR 232 is at the potential of point 214 which is slightly positive with respect to the potential of lead 213. The difference in potential between point 214 and that of lead 213 is the result of the relatively small voltage drop across diode D222. The gate G of the SCR 232 is at the potential of lead 213. Under these conditions, the SCR 232 is held in its nonconducting state. In response to the reversal of polarity of the leads 213 and 212, the lead 213 will become positive and the gate lead G of SCR 232 will be at this positive potential. The lead 212 will be at a negative potential and the point 214 will be at an even more negative potential. Accordingly, the gate lead G of the SCR 232 will be positive with respect to the cathode and current will be able to flow from the lead 212 through the parallel load of the lamp L226 and the sounder S227 through the SCR 232 to the other side of the capacitor C221 at point 214.

Accordingly, there has been shown in FIG. 2 a circuit employing a silicon controlled rectifier which may be substituted for the circuit shown in FIG. 1.

Considering now more specifically the circuit of FIG. 3, it will be seen that the capacitor C321 may be charged in substantially the same manner as described with respect to FIGS. 1 and 2. During the charge time of the capacitor C321, no current can flow from the positive lead 312 through the relay K341 and the diode D343 to the negative lead 313 because the polarity sensitive diode D343 is reverse biased. However, in response to a reverse of the polarity on leads 312 and 313, the diode 343 will be forward biased and current will be able to flow to operate relay K341. In response to the operation of relay K341, its contacts K342 will close thereby completing the circuit for the lamp L326 and the sounder S327 to be operated from the energy stored in capacitor C321.

Each of the circuits 111, 211 and 311 has advantages and disadvantages and the choice of which is used will depend upon a variety of circumstances including: characteristics of the lamp and/or sounder load; size; cost; power supply characteristics and the required repetition rate and/or the number of circuits connected in parallel.

In a typical installation wherein the circuits are used to provide alarm indications in a plurality of locations, it is a common practice to couple a plurality of the alarm circuits across a common line pair and to provide means for continuously supervising the integrity of the common line pair. To incorporate a supervisory circuit, it is customary to provide a bridging resistor across the line at the remote end thereof. This allows a supervisory circuit to check the d.c. continuity of the line and provide an indication if the line goes open. More sophisticated supervisory schemes also provide an indication if the shunt resistance between the lines goes below a predetermined value and/or if the leakage resistance to ground falls below a predetermined value. In general, these schemes do not form a part of the present invention and are not disclosed herein. However, FIGS. 1, 2 and 3 do illustrate optional resistors 116, 216 and 316, respectively, which may be used in the particular one of the circuits which is at the remote end of the line pair. When used, the resistor 116, 216 or 316 may have a value of the order of 2400 ohms or whatever other value is suitable for the supervisoy technique employed.

While there has been shown and described what is considered at the present to be the preferred embodiment of the invention, modifications thereto will readily occur to those skilled in the related arts. For example, instead of a contact actuator, a square wave generator might be used or other forms of polarity sensing means may be used. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. Circuit means for transferring energy from an electrical source to a load and comprising in combination:

a. a source of electrical energy having positive and negative terminals;

b. a load circuit having first and second terminals;

c. coupling means for coupling said first and second terminals of said load to said positive and negative terminals of said source during a first time interval and for coupling said first and second terminals of said load to said negative and positive terms of said source during a second time interval;

d. said load including a capacitor and first polarity responsive means bridged between said first and second terminals for storing energy in said capacitor only during said first time interval; and wherein e. said load circuit further includes an output device and second polarity responsive means coupled together and to said first and second terminals and said capacitor for drawing energy from said capacitor only during said second time interval.

2. The combination as set forth in claim 1, wherein said second polarity responsive means inhibits the flow of current in said output device during said first time interval.

3. The combination as set forth in claim 1, wherein said first polarity responsive means comprises a unidirectional current flow device.

4. The combination as set forth in claim 3, wherein said unidirectional current flow device comprises a diode.

5. The combination as set forth in claim 1, wherein said first time interval is greater than said second time interval.

6. The combination as set forth in claim 5, wherein said second polarity responsive means inhibits and permits current flow in said output device during said second and first time intervals, respectively.

7. The combination as set forth in claim 6, wherein said second polarity responsive means includes current limiting means.

8. The combination as set forth in claim 7, wherein said current limiting means comprises a darlington circuit.

9. The combination as set forth in claim 1 and including a plurality of load circuits coupled in parallel.

10. Circuit means for transferring energy from an energy source to a load and comprising in combination;

a. a two terminal d.c. energy source;

b. a capacitor and polarity responsive means coupled in a first series circuit bridged across the two terminals of said d.c. energy source for charging said capacitor when the polarity of said d.c. energy source is such that said polarity responsive means will pass current;

c. a load;

d. conduction control means coupled to said load for controlling the magnitude of current conduction in said load and the combination coupled to said first series circuit; and wherein e. said conduction control means responds to the polarity of said d.c. energy source by inhibiting and permitting the conduction of current in said load when said d.c. energy source has first and second polarities, respectively.

11. The combination as set forth in claim 10 and including reversing means associated with said two terminal d.c. energy source for periodically reversing the polarity of said two terminal d.c. energy source.

12. The combination as set forth in claim 11, wherein said conduction control means inhibits the conduction of current in said load while said polarity responsive means passes current.

13. The combination as set forth in claim 12, wherein said conduction control means includes a transistor.

14. The combination as set forth in claim 13, wherein said conduction control means comprises a darlington circuit.

15. The combination as set forth in claim 12, wherein at least some of the energy stored in said capacitor, while said d.c. energy source has one polarity, is dissipated in said load when said d.c. energy source has the reverse polarity.

16. The combination as set forth in claim 15, wherein said reversing means periodically reverses the polarity of said two terminal d.c. energy source with first and second time intervals between successive reversals.

17. The combination as set forth in claim 16, wherein said capacitor is charged during said first time interval and said load conducts current during said second time interval.

18. The combination as set forth in claim 17, wherein said first time interval is greater than second time interval.

* * * * *